United States Patent [19]

Sims

[11] 4,389,187

[45] Jun. 21, 1983

[54] EXTENDED HOLDER FOR A LIGHTER

[76] Inventor: Michael H. Sims, 4102 Aquaverde, Austin, Tex. 78746

[21] Appl. No.: 244,216

[22] Filed: Mar. 16, 1981

[51] Int. Cl.[3] ..... F23Q 1/02

[52] U.S. Cl. ..... 431/277; 431/127; 431/143; 431/274; 431/345

[58] Field of Search ..... 431/344, 345, 127, 142, 431/143, 274, 275, 277

[56] References Cited

U.S. PATENT DOCUMENTS

| | | | |
|---|---|---|---|
| 2,728,212 | 12/1955 | Costello | 431/345 X |
| 4,012,298 | 3/1977 | Somosi et al. . | |
| 4,253,818 | 3/1981 | Ogawa | 431/142 |

OTHER PUBLICATIONS

Matchstick brochure.

*Primary Examiner*—Edward G. Favors
*Attorney, Agent, or Firm*—Arnold, White & Durkee

[57] ABSTRACT

A holder for a lighter having a flint and a striking wheel which ignites the fuel contained in the lighter upon rotation of the wheel. One embodiment of the invention includes an elongated frame having an open receptacle at one end. The receptacle is configured to securely retain the lighter during use. The holder also includes an elongated striker movably secured to the frame and adapted for rotating the striking wheel when driven longitudinally during use.

16 Claims, 4 Drawing Figures

EXTENDED HOLDER FOR A LIGHTER

BACKGROUND OF THE INVENTION

The invention relates generally to accessories for lighters and more particularly, it concerns an extended holder for a lighter such as a disposable cigarette lighter, with remote means for striking the lighter.

The standard cigarette lighter includes a fuel reservoir in communication with a flint-emery wheel combination wherein rotation of the emery wheel against the flint creates a spark to ignite fuel from the reservoir.

The majority of these lighters, and indeed the most readily available lighters, are small enough to be held in the palm of the hand to facilitate their use to light a cigarette or other article. Because of their size, the use of these types of lighters are limited to lighting articles which are readily accessible. Also, there use is limited to igniting material which will not flare or material which is not extremely combustible such that there exists no danger of burning the hand before it is withdrawn.

There are in existence lighters and items suitable for reaching pilot lights, fireplace jets, burners and other items which are often located in positions hard to reach. For example, tapers have long been used in churches and other places to light elevated candles. Additionally, specially shaped holders have been made for extending matches into hard to reach places. Both of these apparatus, though, are disadvantageous for some uses because the match or taper must be lit before it is inserted into the hard to reach area, thereby creating the risk of igniting any combustible material positioned between the user and the item desired to be ignited.

It is believed there also exist extended lighters wherein the lighter may be ignited through moving a portion of the body of the lighter to strike a flint. These lighters may overcome the problem of carrying the fire past any combustible material, but they do not offer the advantage of using any conventional, readily available lighter as a fuel source.

SUMMARY OF THE INVENTION

The present invention provides a device for which the fuel supply and igniting system is represented by a standard or conventional lighter. In particular, a holder for a standard lighter having a flint and a striking wheel is provided wherein the holder includes an extended frame having a receptacle configured to securely hold the lighter in use and a remote striker movably secured to the frame and adapted for rotating the striking wheel of the lighter when the striker is driven longitudinally thereby causing the wheel to strike the flint and ignite the lighter.

In a preferred embodiment of the present invention, the frame of the holder has a first end and a second end wherein the receptacle is disposed at the first end. The frame has a bore extending longitudinally from the first end toward the second end and an aperture communicating with the bore and extending out of the frame. The striker includes a rod movably secured within the bore wherein the rod is configured to prevent or minimize rotation within the bore. The rod includes a longitudinal section which resides along the length of the bore and extends out of the bore at the first end of the frame. A transverse section is secured to the rod outside of the bore at the first end such that the rod extends over the receptacle opening at a position corresponding to the top of the striking wheel of the lighter in use. The rod further includes gripping surfaces secured to the transverse section at a position suitable to engage the striking wheel.

A third section is secured to the rod at the opposing end of the longitudinal section and extends out of the aperture. Both the aperture and the third section have a configuration suitable to permit the movement of the rod to cause engagement of the gripping surfaces with the striking wheel to rotate the striking wheel to ignite the lighter.

In one aspect of the preferred embodiment, the bore has an offset bored section disposed parallel to the bore and extending inwardly from the first end of the frame for a selected length. The offset section has a suitable width and depth such that the upper portion of the rod near the first end of the frame may be selectively recessed back into the offset section to accommodate the insertion and removal of a lighter from the receptacle.

In another aspect of the preferred embodiment, the aperture is configured to form a longitudinally disposed slot extending inwardly from a side of the frame to transversely intersect the bore. The third section of the rod is further secured transversely to the longitudinal section of the rod to extend out of the slotted aperture. The third section of the rod has a width slightly less than the width of the slot such that the sides of the slot limit the rotation of the rod by limiting the lateral movement of the third section within the slot. Further, the length of the slot is sufficient to accommodate the longitudinal movement of the third section within the slot to cause the transverse section to engage the striking wheel to ignite the lighter.

In a more preferred aspect of the present invention, the shape of the bore along its length is defined by a first longitudinal segment which begins at the first end of the frame and extends inwardly, a second longitudinal segment aligned parallel to the first segment and a slotted region connecting the first segment and the second segment. The slotted region has a preselected length and width wherein the width is at least as great as the distance between the first longitudinal segment and the second longitudinal segment. The rod then includes an offset section disposed along the length of the longitudinal section of the rod at a position corresponding to the slotted region such that the offset section connects the longitudinal section of the rod in the first longitudinal segment of the bore with the longitudinal section of the rod in the second longitudinal segment of the bore. The offset section of the rod has a thickness slightly less than the thickness of the slotted region whereby the offset section of the rod within the slotted region precludes or minimizes the rotation of the rod in use. In this aspect, the length of the slotted region is sufficiently greater than the longitudinal dimension of the offset section of the rod such that sufficient longitudinal movement of the rod is permitted to enable the striking of the lighter by such movement.

It should be noted that for this embodiment, the first longitudinal segment and the second longitudinal segment of the bore may be aligned concentrically. For this variation, the offset section is analogous to a key and a keyway simply acting to prevent rotation.

Alternatively, the first and second longitudinal segments may be offset by distance wherein the rod has a truly offset section. Since the portion of the longitudinal section of the rod in the first longitudinal segment of the bore cannot have the same axis of rotation as that portion in the second longitudinal segment of the bore, either the offset section or the second portion may act to preclude rotation of the rod.

In a more preferred aspect of the present invention, the gripping surfaces include a collar secured to the transverse section of the rod at a position suitable to engage and rotate the striking wheel.

In an alternative aspect of the present invention, the bore may have a polygonal configuration in cross-section. The longitudinal section of the rod may then have a corresponding polygonal cross-section configuration of slightly smaller dimension such that rotation of the rod within the bore is again minimized or precluded. It will be understood that the polygonal configuration of the rod need not have the same shape as that of the bore. For example, the bore may be hexagonal while the rod is square so long as two opposing sides of the rod closely fit within two opposing sides of the bore to preclude rotation.

Accordingly, the present invention provides a holder for the standard lighter which provides a remote means for striking a lighter such that the lighter may be ignited immediately adjacent the item to be lit, thereby obviating the need to carry the fire by any combustible material between the user and the item to be lit. Further, the holder has the advantage of being able to use a conventional lighter which is readily available in the market place.

BRIEF DESCRIPTION OF THE DRAWINGS

This invention will further be illustrated in reference to the appended drawings which illustrate particular embodiments of the holder in accordance with this invention.

DESCRIPTION OF THE PREFERRED EMBODIMENTS

Figure 1:
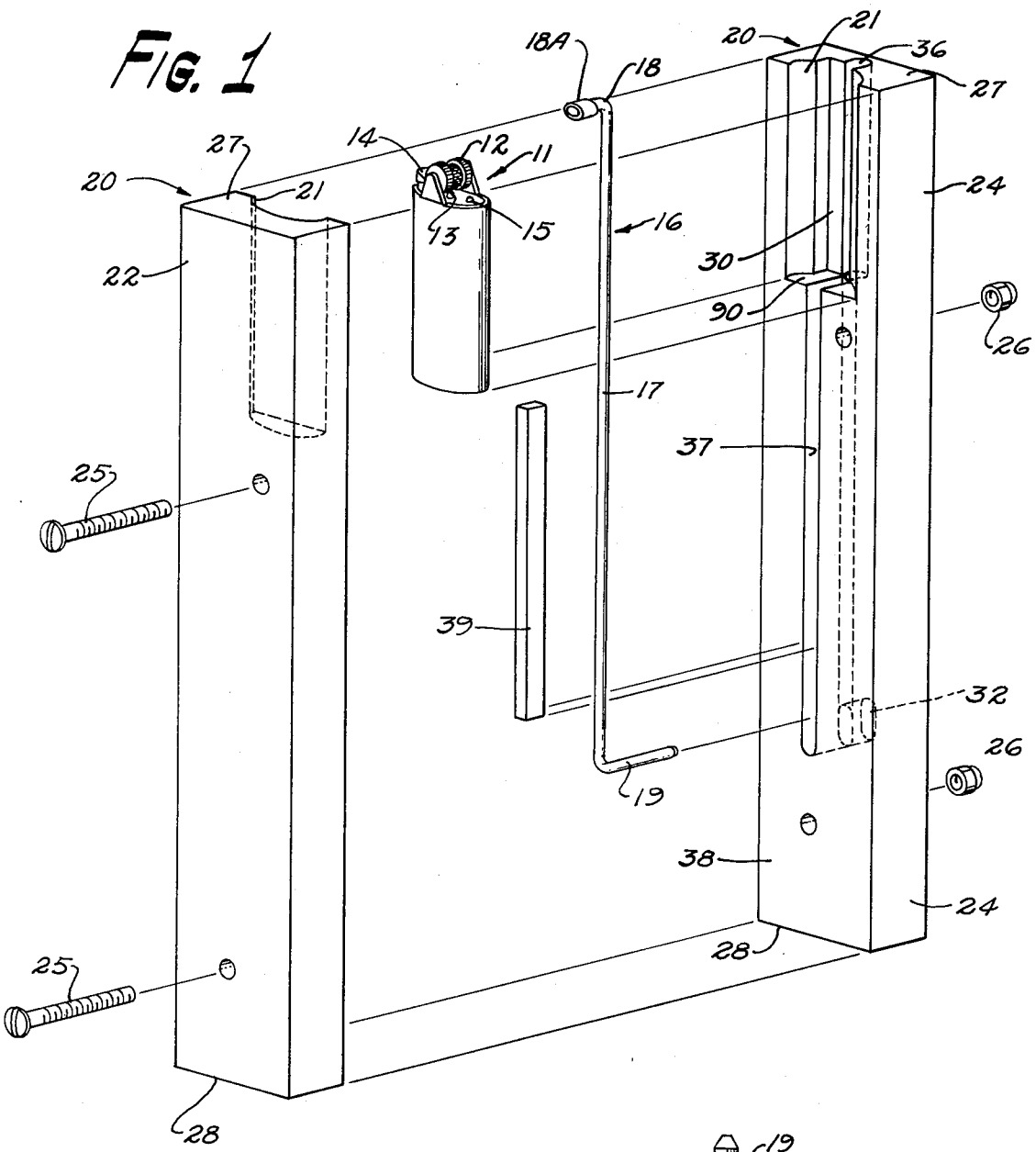
FIG. 1 is an exploded perspective view of a holder in accordance with the present invention.

The preferred embodiment of the holder 10 is generally represented by a frame 20 and a striker or rod 16 movably secured to the frame 20. The frame 20 and striker 16 are adapted to be used with a standard lighter 11 secured to the frame 20.

Referring to FIG. 1, the lighter 11 which may be utilized with the present invention typically includes a striker wheel or emery wheel 12, flint 13 which is frictionally engaged with the striker wheel 12 to give off sparks upon rotation of the wheel 12, and a fuel feed point 15. For lighters fueled by butane, the fuel feed point 15 is represented by a nozzle through which the butane gas is expelled to provide fuel for the flame when lit. In turn, the butane lighter typically includes a fuel valve lever 14 for controlling the flow of butane through the fuel nozzle at the fuel feed point 15.

For the more conventional lighter using a standard, liquid lighter fuel, the fuel feed point 15 is generally represented by a wick which is saturated by the liquid fluid. As can be appreciated by one skilled in the art, the holder of the present invention can be adapted to be used with any type of lighter. One shape and type lighter is disclosed herein by way of example only.

The frame 20 has an open receptacle 21 which is configured so as to securely retain the lighter 11 in place during use. In the preferred embodiment, the frame 20 may comprise a first half 22 and a second half 24 which may be held together by bolts 25 and nuts 26 or by other suitable fastening means.

The first half 22 and the second half 24 each have a first end 27 and a second end 28. Similarly, the first half 22 and the second half 24 have opposing channels or grooves disposed at the first end 27 which form receptacle 21 when the two halves 22, 24 are connected together. The receptacle 21 is configured to securely hold the lighter 11 in use when halves 22, 24 are secured together.

The frame 20 of FIG. 1 further includes a passage or bore 30 which is longitudinally disposed within half 24 and extending from the first end 27 toward the second end 28. In the embodiment of FIG. 1, the bore 30 is positioned adjacent the receptacle 21 in the second half 24 of the frame 20 such that is extends from the first end 27 past the bottom 90 of the receptacle 21 toward the second end 28 of the frame 20. The bore 30 may proceed out of the second end 28 or may terminate within the frame 20 at a selected location.

The frame 20 may have an aperture 32 in communication with the bore 30. In the preferred embodiment, the aperture 32 forms a slot which is longitudinally disposed and intersects the bore 30. The aperture 32 may extend out of any of the external surfaces or sides of the frame 20.

The passage or bore 30 may further include various sections such as an offset bored section 36. The offset bored section 36 is disposed parallel to the receptacle 21 and extends from the first end 27 of the frame 20 for a predetermined length toward second end 28. The offset section 36 has a suitable width and depth such that the portion of the rod 16 near the first end 27 of the frame 20 may be selectively recessed back into the offset section 36 to accommodate the removal and insertion of the lighter 11 from the receptacle 21 (see FIG. 2). In the embodiment of FIG. 1, the offset bored section 36 is configured as a semi-circular based groove with parallel sides extending to the receptacle 21. The diameter of the semi-circular based groove of the bored offset section 36 is slightly greater than the diameter of the rod 16 so that the rod 16 may be easily recessed into the offset bored section 36 to accommodate the removal and insertion of the lighter.

The member of the present embodiment which actuates or strikes the lighter 11, termed for the purposes of this application as the "striker", is movably secured to the frame such that when driven longitudinally, it engages the striking wheel 12 to rotate the wheel 12 to create the spark necessary to ignite the fuel of the lighter. In the embodiment of FIG. 1, the striker may be formed of a rod 16 having a longitudinal central section 17, an upper transverse section 18 and a third or handle section 19 which typically functions as a handle for the striker. In the present instance, the striker is comprised of a cylindrical metal rod of substantially constant diameter wherein the diameter of the longitudinal section 17 is slightly smaller than the diameter or width of the bore 30 thereby allowing rod 16 to move longitudinally within bore 30. Also, the diameter of the third section 19 of rod 16 is slightly less than the width of the slotted aperture 32 such that the sides of the slotted aperture 32 constrain rotation about the longitudinal axis of section 17 of the rod through limiting contact between the sides of the aperture 32 and the third section 19.

Figure 2:
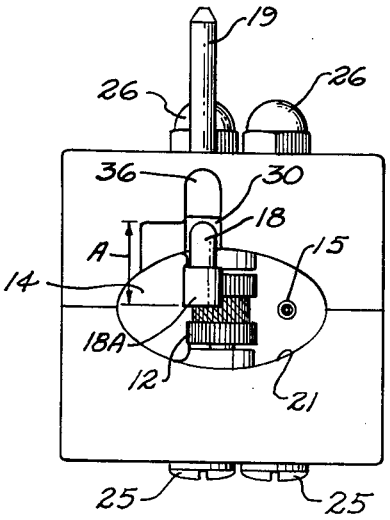
FIG. 2 is a perspective view of the assembled holder illustrating the respective positions of the various component parts.

As best seen in FIG. 2, the longitudinal section 17 extends out of the first end 27 such that the transverse section 18, secured transversely to the longitudinal section 17, extends over the opening of the receptacle and is positioned to engage the striking wheel 12 when the rod 16 is driven longitudinally downwardly. Gripping surfaces 18A are secured to the transverse section 18 to frictionally engage the striking wheel 12 so that movement of the transverse section 18 downwardly to contact the striking wheel 12 tends to rotate the striking wheel 12 to create the spark necessary for ignition. The length of section 18, shown as dimension A on FIG. 2, is such that when the upper portion of rod 16 is recessed into the offset bored section 36, section 18 does not extend over the opening of receptacle 21. Therefore, when rod 6 is so recessed, a lighter 11 may be easily inserted or removed from receptacle 21 without disassembling the holder 10.

As can be appreciated, the frictional surfaces 18A may include any rough or tacky surfaces suitable for gripping the striking wheel 12 upon engagement. In the preferred embodiment, the transverse section 18 has a non-circular cross-section such as oval in which the longer axis of the oval is horizontally disposed in use, rather than a circular cross-section. The gripping surfaces 18A may include a plastic collar of suitable size to engage the striking wheel. The collar has a diameter or dimension such that the collar is frictionally fitted over the transverse section 18. The collar is therefore secured in use to the end of the transverse section 18 by the irregular shape of the transverse section 18 and the tension of the friction fit, which minimize rotation of the collar about section 18. It will be understood, however, that other suitable surfaces may be utilized in accordance with the present invention. As for example, a metal gripping surface may be provided by a friction fitted metal collar or engaging grooves may be made directly into section 18.

The utilization of a brass or other metal rod offers the advantages of the rod 16 having sufficient elasticity to allow it to be flexed back into the offset bored section 36 for the removal and insertion of a lighter 11 while still returning to its original position once this operation has been completed. It will be understood, however, that other materials exhibiting both the suitable elasticity and the needed tensile strength to rotate the striking wheel 12 for ignition may be utilized in accordance with the present invention.

In the embodiment illustrated in FIG. 1, bore 30 includes a groove 37 which is provided to facilitate the insertion of the rod 16 into the bore 30 upon assembly of the entire holder 10. An insert 39 may therefore be provided to fill in space between the rod 16 when in place and the mating surface of the first half 22. The insert 39 thereby minimizes the freedom of movement of the rod 16 once it is in place in the assembled holder 10.

As can be understood from the above description, the subject holder 10 can be used in its assembled condition to operate a standard lighter 11. Thus, when assembled, the operator simply inserts lighter 11 into receptacle 21 by exerting an outward force on section 18 thereby flexing rod 16 into groove 36. The length of section 18 of rod 16 is such that when rod 16 is flexed into groove 36, the opening of receptacle 21 is clear and lighter 11 may be inserted downwardly into position. Once the lighter 11 is in position, rod 16 is released and flexes back into the position of FIG. 2 adjacent lighter 11 with section 18 aligned over the wheel 12.

In order to operate the device, the operator simply exerts a downward force on section 19 thereby longitudinally driving rod 16 downwardly and causing section 18 to engage wheel 12. By continuing to exert such a downward force, section 18 causes wheel 12 to rotate and produce sparks. Section 18 also engages fuel lever 14 and maintains it in an open position and the fuel from valve 15 is ignited. This flame continues until the operator shifts rod 16 upwardly and returns rod 16 and section 18 to its starting position of FIG. 2. The device is then ready for re-use.

Figure 3:
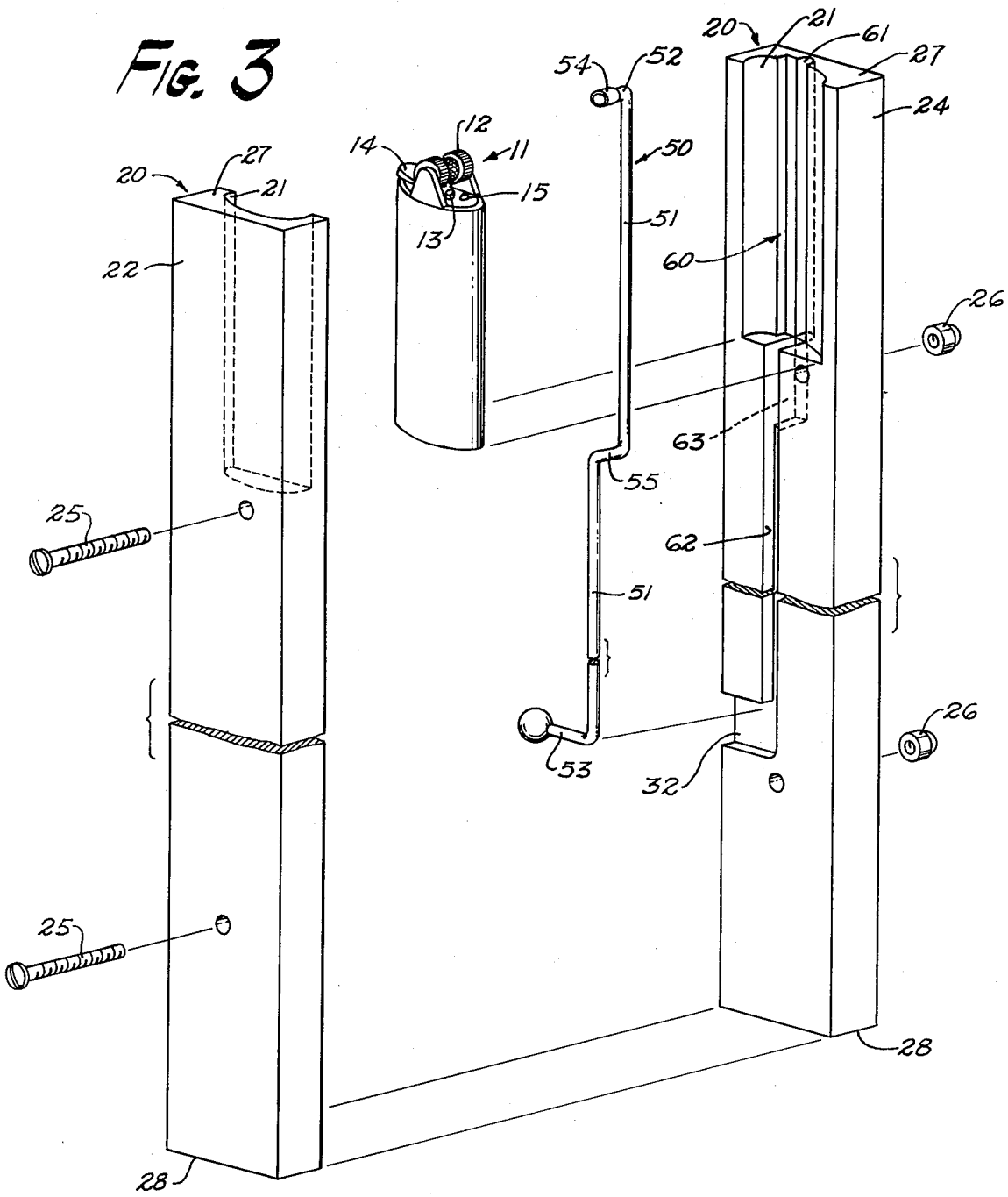
FIG. 3 is an exploded perspective view of an alternative embodiment of the holder in accordance with the present invention.

Turning now to FIG. 3, an alternative embodiment of a holder in accordance with this invention is shown. In this embodiment, the frame 20 and lighter 11 interact in essentially the same capacity as that described for the embodiment of FIGS. 1–2 and accordingly, similar parts are given the same numbers as those of FIGS. 1 and 2.

Referring to FIG. 3, the illustrated embodiment comprises a frame 20 having a receptacle 21 for securing the lighter 11. In the present instance, the frame again includes a first half 22 and a second half 24 wherein each half has a portion of the cavity forming the receptacle 21.

The present embodiment differs from the embodiment of FIGS. 1 and 2 in the shape or configuration of the striker or rod and in the way it is inserted into the second half 24 of the frame 20. In particular, the striker may be a rod 50 which has upper and lower longitudinal sections 51 divided by an offset section 55 substantially normal to sections 51. In the illustrated embodiment, the offset section 55 is disposed such that the rod 50 is fitted around the receptacle 21 when the rod 50 is in place.

The rod 50 further includes a transverse section 52 and gripping surfaces 54 similar to those included for the rod 16 in FIGS. 1–2. Also, for the embodiment illustrated in FIG. 3, a third section 53 is similar in function to the handle or third section 19 of FIGS. 1 and 2, but has been extended out of a different surface of frame 20 for illustrative purposes from that shown for FIGS. 1 and 2. The aperture 32, however, may again have a suitable slotted configuration to closely fit the sides of the third section 53 to constrain axial rotation or twisting movement of the rod 50 while allowing longitudinal movement of the rod 50 to cause section 52 to strike the lighter 11.

Just as the shape of the rod 50 is varied to include an offset section, so, too, the bore 60 is made to conform to the shape of the rod 50. In particular, the bore 60 has a first longitudinal groove or segment 61, a second longitudinal groove or segment 62 parallel to the first longitudinal segment 61, and a slotted segment 63 connecting the first longitudinal segment 61 to the second longitudinal segment 62. Similarly to the embodiment of FIGS. 1 and 2, the upper or first longitudinal groove or segment 61 is longitudinally offset from the second longitudinal segment 62 by a distance sufficient to permit the rod 50 to be recessed and thereby permit the lighter 11 to be placed into the receptacle when installed. The slotted region 63 therefore has a transverse dimension sufficiently great to connect the first longitudinal segment 61 and the second longitudinal segment 62. Additionally, the size of the slotted segment 63 is sufficient to accommodate the longitudinal movement of the offset section 55 of rod 50 during the striking operation of the lighter 11 as rod 50 is driven longitudinally.

It should be understood that in this embodiment, the rotation of the rod 50 may be constrained by a multitude of ways. For example, the relative axial rotation of the rod 50 may be limited by the shape of the aperture 32 interacting with the third section 53 of rod 50 to prohibit latitudinal movement of the third section 53. Alternatively, the lower longitudinal section 51 could be extended out of the second end 28 of the frame 20 wherein the aperture 32 would be positioned at the second end 28 instead of on a side. Rotation of the rod 50 must then be constrained by either of the sides of the slotted segment 63 interacting with the offset section 55 to substantially preclude axial rotation or twisting of rod 50 or by the configuring the first longitudinal segment 61 and the second longitudinal segment 62 sufficiently close to the upper and lower sections 51 of the rod 50 to prevent movement. For each of these variations, it should be noticed that the irregular shape of the rod 50 within the frame 20 avoids the possibility of all the portions of the rod 50 within the frame 20 having a common axis of uninhibited rotation which would allow twisting of rod 50 within frame 20.

With this principle in mind, it will now be understood that for the rod 16 shown in FIG. 1, the longitudinal section 17 could again be extended out of the second end of 28 so long as the rod 16 includes an offset section or key and so long as the second half 24 of the frame 20 has a matching keyway in order to prohibit rotation.

In turn, the importance of limiting rotation of rod 16 within frame 20 may be best observed in FIG. 2 wherein it may be noted that axial rotation of the rod 16 would rotate the transverse section 18 out of position away from the striking wheel 12 thereby precluding the effective operation of the holder 10.

Figure 4:
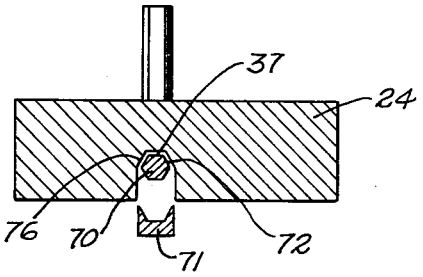
FIG. 4 is a cross-sectional view of a holder having a polygonal rod and bore.

FIG. 4 illustrates an alternative means of precluding rotation of the rod suitable for the embodiment shown in FIGS. 1 and 2. In this instance, the bore 37 and the rod 70 may take any matching polygonal shape such that the axial rotation of the rod 70 within the bore 37 is precluded. For the embodiment shown in FIG. 1, it may further be necessary to include a shaped insert 71 in place of insert 39 also configured to conform with the rod 70 to hold the rod 70 in place. It will further be understood that the rod 70 and the bore 37 need not have identical polygonal configurations so long as the sides 76 of the bore 37 effectively mate with a plurality of the sides 72 of the rod 70 to preclude rotation of the rod. For example, in the instance illustrated in FIG. 4, the bore 37 could be rectangular or square so long as the sides 76 of the bore 37 closely conformed to the opposing sides 72 of the shaped rod 70.

The instant invention has been disclosed in connection with specific embodiments. However, it will be apparent to those skilled in the art that variations for the illustrated embodiments may be undertaken without departing from the spirit and scope of the invention. For example, the entire cavity or receptacle 21 may be encapsulated in one-half of the frame while the groove or bore is provided in the opposing half. Additionally, the frame may easily take a unitary body construction by providing a polygonal bore extending longitudinally through the entire body and the rod having a suitable polygonal shape to preclude rotation of the rod within the bore. The lower or handle section of the rod extending from the frame should then be detachably secured so that it may be removed from the rod to insert and remove the rod from the main body. Such a construction would permit the injection molding of the holder and facilitate the replacement of the lighter and the receptacle. These and other variations will be apparent to those skilled in the art and are within the spirit and scope of the invention.

What is claimed is:

1. A holder for a conventional lighter having a flint and a striking wheel which ignites the lighter fuel upon rotation, the holder comprising:

(a) an elongated frame having an open receptacle at a first end, the receptacle configured to securely retain such a lighter during use; and (b) an elongated striker means movably secured to the frame for frictionally engaging and rotating the striking wheel of such a lighter when driven longitudinally during use.

2. The holder of claim 1 wherein the frame has a passage extending longitudinally from the first end of the frame to an external surface of the frame and the striker means is mounted within said passage and configured to minimize axial rotation within said passage.

3. The holder of claim 2 wherein the striker means includes a transverse section at one end which extends over the opening of the receptacle and positioned to engage the striking wheel of the lighter in use.

4. The holder of claim 3 wherein the transverse section includes a gripping surface adapted to frictionally engage said striking wheel.

5. The holder of claim 2 wherein the striker means includes a handle section extending from the passage at the external surface of the frame, said handle section adapted to permit longitudinal movement of the striker means within the passage.

6. The holder of claim 2 wherein the passage has an offset bored section disposed parallel to the passage extending inwardly from the first end of the frame for a predetermined length, the offset section having a suitable width such that a portion of the striker means near the first end of the frame may be selectively released into the offset section to accommodate the insertion and removal of a lighter from the receptacle.

7. The holder of claim 5 wherein the passage is configured to form a longitudinally disposed slot extending inwardly from a side of the frame and wherein the handle section is secured transversely to the striker means to extend out of the slotted passage and has a width slightly less than the width of the slot.

8. The holder of claim 2 wherein the shape of the passage along its length is defined by a first longitudinal segment proximate the first end of the frame, a second longitudinal segment aligned parallel to the first segment, and a slotted region connecting the first segment and the second segment, the slotted region having a preselected length and width, and wherein the striker means within this said passage includes an offset section positioned within the slotted region to prevent axial rotation of said striker means while permitting the longitudinal movement of the striker means sufficient to engage and rotate the striking wheel.

9. The holder of claim 2 wherein the passage has a polygonal configuration in cross-section and wherein the striker means has a complementary polygonal cross-sectional configuration shaped to substantially preclude rotation of the striker means within the passage.

10. A holder for a lighter having a flint and a striking wheel which ignites the lighter fuel upon rotation, the holder comprising:

(a) an elongated frame having an open receptacle at a first end, the receptacle configured to securely retain such a lighter during use, the frame further having a passage extending longitudinally from the first end of the frame to an external surface of the frame; and (b) an elongated striker movably secured to the frame and adapted for rotating the striking wheel when driven longitudinally during use, the striker being mounted within the passage and configured to minimize axial rotation within the passage, wherein the passage further has an offset bored section disposed parallel to the passage extending inwardly from the first end of the frame for a predetermined length, the offset section having a suitable width such that a portion of the striker near the first end of the frame may be selectively recessed into the offset section to accommodate the insertion and removal of such a lighter from the receptacle.

11. A holder for a lighter having a flint and a striking wheel which ignites the lighter fuel upon rotation, the holder comprising:

(a) an elongated frame having an open receptacle at a first end, the receptacle configured to securely retain such a lighter during use, the frame further having a passage extending longitudinally from the first end of the frame to an external surface of the frame wherein the passage is configured to form a longitudinally disposed slot extending inwardly from a side of the frame; and (b) an elongated striker movably secured to the frame and adapted for rotating the striking wheel when driven longitudinally during use, the striker being mounted within the passage and configured to minimize axial rotation within the passage and including a handle section secured transversely to the striker to extend out of the longitudinally disposed slot, the handle section having a width slightly less than the width of the slot and being adapted to permit longitudinal movement of the striker within the passage.

12. A holder for a lighter having a flint and a striking wheel which ignites the lighter fuel upon rotation, the holder comprising:

(a) an elongated frame having an open receptacle at a first end, the receptacle configured to securely retain such a lighter during use, the frame further having a passage extending longitudinally from the first end of the frame to an external surface of the frame, the shape of the passage along its length being defined by a first longitudinal segment proximate the first end of the frame, a second longitudinal segment aligned parallel to the first segment, and a slotted region connecting the first segment and the second segment, the slotted region having a preselected length and width; and (b) an elongated striker movably secured to the frame and adapted for rotating the striking wheel when driven longitudinally during use, the striker being mounted within the passage and including an offset section positioned within the slotted region to prevent axial rotation of said striker while permitting the longitudinal movement of the striker sufficient to engage and rotate the striking wheel.

13. A holder for a lighter having a flint and a striking wheel which ignites the lighter fuel upon rotation, the holder comprising:

(a) an elongated frame having an open receptacle at a first end, the receptacle configured to securely retain such a lighter during use, the frame further having a passage extending longitudinally from the first end of the frame to an external surface of the frame, the passage having a polygonal configuration in cross-section; and (b) an elongated striker movably secured to the frame and adapted for rotating the striking wheel when driven longitudinally during use, the striker being mounted within the passage and having a polygonal cross-sectional configuration complementary to that of the passage in order to substantially preclude rotation of the striker within the passage.

14. A holder for a conventional disposable lighter having a flint and a striking wheel which ignites the lighter fuel upon rotation, the holder comprising:

(a) an elongated frame including a means for removably securing such a disposable lighter at a first end of the frame; and (b) a means for frictionally rotating such a striking wheel to ignite such a lighter, wherein the frictional rotating means is adapted to be actuated remotely from the first end of the frame.

15. The holder of claim 14 wherein the means for removably securing such a lighter includes an open receptacle positioned at the first end of the frame and configured to removably retain such a lighter in use.

16. The holder of claim 15 wherein the means for frictionally rotating such a striking wheel includes an elongated striker movably secured to the frame and adapted to frictionally engage and rotate such a striking wheel when driven longitudinally during use.

* * * * *

UNITED STATES PATENT OFFICE

CERTIFICATE OF CORRECTION

Patent No. 4,389,187 Dated June 21, 1983

Inventor(s) Michael H. Sims

It is certified that error appears in the above-identified patent and that said Letters Patent are hereby corrected as shown below:

Column 4, line 23, "is" should read -- it --.

Column 4, line 43, "see" should read -- See --.

Column 5, line 20, "6" should read -- 16 --.

Column 8, line 42, "released" should read -- recessed --.

Signed and Sealed this

*Twenty-seventh* Day of *September 1983*

[SEAL]

*Attest:*

GERALD J. MOSSINGHOFF

*Attesting Officer* *Commissioner of Patents and Trademarks*